United States Patent [19]

Bschorr

[11] 4,228,869

[45] Oct. 21, 1980

[54] VARIABLE VOLUME RESONATORS USING THE BELLEVILLE SPRING PRINCIPLE

[75] Inventor: Oskar Bschorr, Munich, Fed. Rep. of Germany

[73] Assignee: Messerschmitt-Bolkow-Blohm GmbH, Munich, Fed. Rep. of Germany

[21] Appl. No.: 11,778

[22] Filed: Feb. 12, 1979

Related U.S. Application Data

[63] Continuation-in-part of Ser. No. 812,617, Jul. 5, 1977, Pat. No. 4,149,612.

[30] Foreign Application Priority Data

Jul. 17, 1976 [DE] Fed. Rep. of Germany ..... 2632290
Aug. 9, 1978 [DE] Fed. Rep. of Germany ..... 2834823

[51] Int. Cl.[3] ..... E04B 1/82; G10K 11/10
[52] U.S. Cl. ..... 181/286; 181/295
[58] Field of Search ..... 181/284, 286, 288, 291, 181/293, 294, 295

[56] References Cited

U.S. PATENT DOCUMENTS

| | | | |
|---|---|---|---|
| 2,153,357 | 4/1939 | Wente | 181/291 |
| 2,502,017 | 3/1950 | Beers | 181/295 |
| 2,502,018 | 3/1950 | Olson | 181/295 |
| 2,502,019 | 3/1950 | Olson | 181/295 |
| 2,502,020 | 3/1950 | Olson | 181/295 |
| 2,840,179 | 6/1958 | Junger | 181/286 |
| 3,422,921 | 1/1969 | Warnuka | 181/286 |
| 4,149,612 | 4/1979 | Bschorr | 181/286 |

FOREIGN PATENT DOCUMENTS

| | | | |
|---|---|---|---|
| 102914 | 1/1938 | Australia | 181/295 |
| 697865 | 9/1940 | Fed. Rep. of Germany | 181/295 |
| R 12357 | 7/1956 | Fed. Rep. of Germany | 181/295 |
| 2235452 | 1/1974 | Fed. Rep. of Germany | 181/295 |

*Primary Examiner*—Donald A. Griffin
*Assistant Examiner*—Benjamin R. Fuller
*Attorney, Agent, or Firm*—W. G. Fasse; D. F. Gould

[57] ABSTRACT

The present variable volume resonators have an inner volume enclosed by wall members constructed as Belleville springs. The wall members confine in said volume a pressure which is reduced relative to atmospheric pressure, whereby the springs have a small spring constant in response to a reduced pressure load. Each resonator is so constructed that it has a relatively large resonating surface and a relatively low resonating mass. The sound damping effect of the resonator volume is enhanced by means of various types of damping devices including a high viscosity residual gas, wire mesh members, or liquid drops in the volume interior. The present resonators also comprise features for compensating air pressure and/or the resonance frequency.

11 Claims, 18 Drawing Figures

FIG. 10
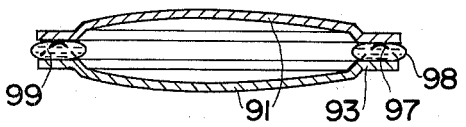
FIG. 11
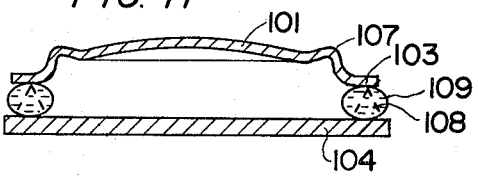
FIG. 17
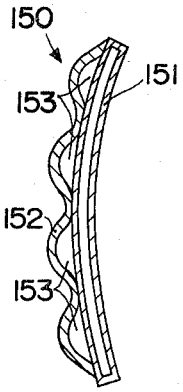
FIG. 12
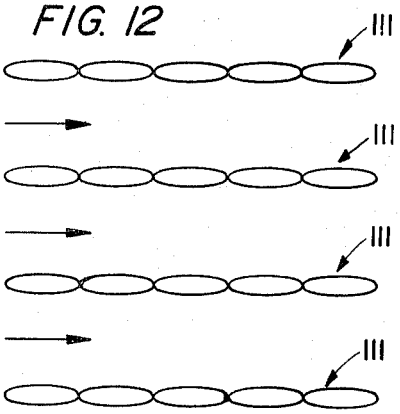
FIG. 18
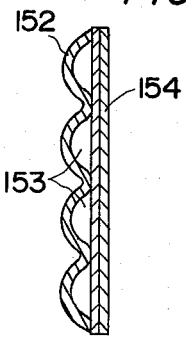
FIG. 13
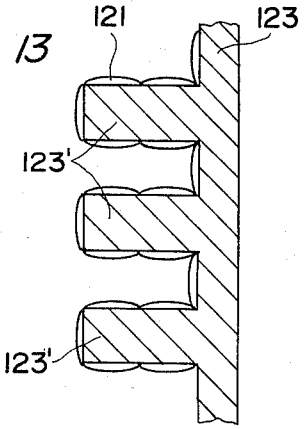
FIG. 14
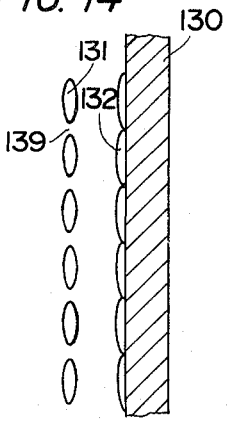
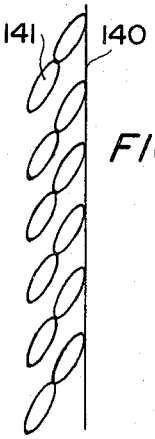
FIG. 15
FIG. 16
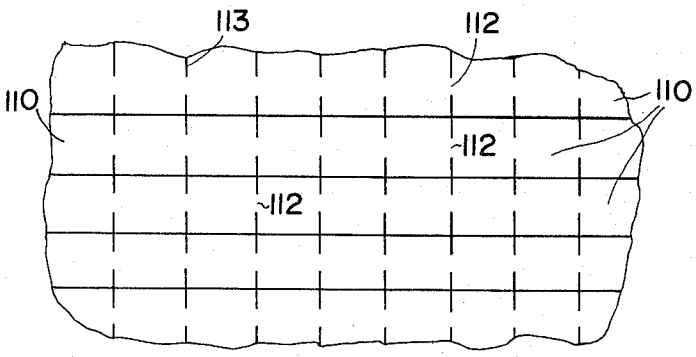

VARIABLE VOLUME RESONATORS USING THE BELLEVILLE SPRING PRINCIPLE

CROSS REFERENCE TO RELATED APPLICATIONS

The present patent application is a continuation-in-part application of my copending application U.S. Ser. No. 812,617; filed: July 5, 1977, now U.S. Pat. No. 4,149,612, issued on Apr. 17, 1979.

BACKGROUND OF THE INVENTION

The present invention relates to noise reducing resonator devices having a relatively small structural volume which is variable and which has a high admittance. Such devices are suitable for reducing noise pollution in the air and other gaseous, vaporous and liquid media.

The reduction of noise is part of the protection of our environment and constitutes a foremost problem especially in workshops, offices, and the like. Many possibilities are available for such noise reduction. However, economical and technical considerations frequently prevent the use of known devices for the intended noise reduction purpose.

It has been suggested to reduce noise by means of destructive interference, please see "Journal of Sound and Vibration", 1970, Nr. 2, pages 223–233, by Czarnecki. This prior art suggests using so-called Helmholtz resonators located near a source of noise which excites the resonators to oscillate in phase opposition thereby contributing to an interference quenching of the noise. This effect may be interpreted as a mismatching of the radiation resistance due to the resonators. Yet another interpretation based on multi-pole analysis suggests that the source of noise which originally operates as a monopole, is transformed into a pole of higher order having a lower operational efficiency.

Helmholtz resonators are frequently used in connection with sound absorbers or dampers. The arrangement may be a series connection or a parallel connection, whereby sound absorbing or damping and sound insulation may be accomplished. As such, Helmholtz resonators are simple and very efficient structural elements. However, a disadvantage resides in the fact that these resonators require a large structural volume in the lower frequency range. On the other hand, a Helmholtz resonator has a relatively narrow frequency band or range in which it operates efficiently. Thus, due to the required volume it is not always possible to utilize several, differently tuned Helmholtz resonators.

Other well known mechanical resonators, for instance, plates oscillating along with the noise source have an input impedance which is too high, in other words, their admittance is too low so that they are efficient only where a large surface area may be exposed to the sound or noise to be reduced.

OBJECTS OF THE INVENTION

In view of the foregoing, it is the aim of the invention to achieve the following objects, singly or in combination:

- to construct variable volume resonators which in addition have a small structural volume and a high admittance;
- to provide sound reducing devices which may be arranged in any desired pattern or configuration, such as a line arrangement or a surface arrangement;
- to reduce the material and manufacturing costs of resonators of the type described above;
- to reduce the resonating mass while simultaneously increasing the resonating surface of the present noise reducing devices;
- to influence the damping, particularly to increase the damping effect;
- to provide means for compensating air pressure variations in noise damping devices;
- to construct so-called "noise shutters" by integrating a plurality of the present resonator elements into such noise shutter structures; and
- to construct acoustically absorbing wall members from a plurality of the present variable volume resonators.

SUMMARY OF THE INVENTION

The variable volume resonator members of the present invention are formed by wall elements functioning in accordance with the Belleville or cup spring principle. According to said principle, the wall elements of such resonator members have a small or even negative spring constant when the resonator volume is subjected to reduced pressure loading of the wall elements. The wall elements have an offset or shoulder along the outer edge and have a cone shaped or spherical surface or a curved surface of a still higher order. The surface curvature or vaulting has a height "h". The wall elements have a thickness "s" and the resonator members have a diameter "d" which is preferably measured at said offset or shoulder. According to the invention the vaulting height "h" and the diameter "d" are related to the wall thickness "s" as follows:

$$h=(0.5 \text{ to } 5.0)s$$

and $$d=(30 \text{ to } 300)s.$$

The inner or central portion of the wall elements may be thinner than the outer portion in order to reduce the resonating or oscillating mass of the wall elements. The inner portion of the wall elements may be reinforced by bending resistant support struts for increasing the resonating or oscillating surface area of the wall elements.

BRIEF FIGURE DESCRIPTION

In order that the invention may be clearly understood, it will now be described, by way of example, with reference to the accompanying drawings, wherein:

FIGS. 10 and 11 show respective sections through resonator members with means for compensating external pressure changes;

FIG. 12 illustrates schematically the arrangement of a plurality of resonator members forming an acoustical noise shutter;

FIGS. 13 to 15 illustrate several examples of how a plurality of resonator members according to the invention may be combined for forming acoustically absorbing walls;

FIG. 16 shows schematically a plurality of rectangular or square resonator members forming a wall and interconnected by flow channels;

FIG. 17 is a sectional view through an embodiment with a barometric spring wall element for compensating external pressure variations; and FIG. 18 is a view similar to that of FIG. 17 but using a bimetal strip wall element for compensating temperature variations.

DETAILED DESCRIPTION OF PREFERRED EXAMPLE EMBODIMENTS AND OF THE BEST MODE OF THE INVENTION

Figure 1:
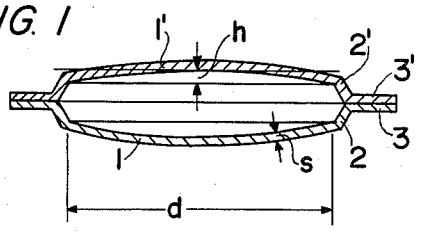
FIG. 1 illustrates a sectional view through a resonator member with a shoulder or offset near the outer edge.

FIG. 1 illustrates an example embodiment of a resonator member according to the present invention with simple structural features and an improved material utilization. The resonator member comprises two curved, vaulted or arched wall elements 1 and 1'. The wall elements 1 and 1' are connected together along flanges 3, 3' thereby forming an airtight inner volume. The flanges 3, 3' constitute respective peripheral areas. The inner volume is evacuated or partially evacuated. The wall elements 1, 1' have shoulders or offset ridges 2, 2' arranged near the outer edges adjacent to the flanges whereby said shoulders or offset ridges 2, 2' are located between the flanges 3, 3' and the central area of the respective wall element.

The wall elements 1, 1' are substantially flat in the effective loading region and have a low spring constant due to the partially evacuated or reduced pressure condition of the inner volume. An unrestricted vibration or oscillation of the wall elements 1, 1' would not be possible without the shoulders 2. However, spacing members between the flanges 3, 3' would have substantially the same effect as the shoulders 2, 2'. It is advantageous to construct the wall elements 1, 1' to be rotationally symmetric. The shoulders may have the shape of a truncated cone, as best seen, for example, in FIGS. 1, 2, 3, 6, 7, and 8.

The shape of the curvature, vaulting or convexity of the wall elements 1, 1' may be chosen largely as desired to provide at least one of the wall elements with a domed shape. Besides the truncated cone or frustum shape of the original Belleville spring, a spherical surface or a surface of a higher order may be used for the shape of the wall members 1, 1'. A curvature of the nth power order is to be understood to have a vaulting or arching defined by an nth power mathematical function. The border regions of curved surfaces corresponding to higher order power functions resonate more intensively than the center portions, so that a better utilization factor is obtained. The use of a material such as steel, for example, for the wall members 1, 1' would require a surface curvature height "h" which is in the range of about 0.5 to 5.0 times the thickness "s" of the wall elements. A height "h" to thickness "s" proportion of $h=1.5s$ is preferred. The diameter "d" preferably measured at the shoulder 2, 2' of the wall elements is in the range of about 30 to 300 times the wall element thickness "s". Making the wall elements of materials with a relatively low elasticity modulus will result in a smaller diameter "d" of the wall 1, 1' having regard to the root function. Preferably, the materials used for the wall elements are gas tight, have a small density, a high elasticity modulus, and a high yield point value and a high vibration loading capability. Examples of such materials are light metals such as beryllium, aluminium, and magnesium, as well as glass and fiber materials.

FIGS. 2 to 5 illustrate embodiments wherein the vibrating or resonating surface area is increased while simultaneously reducing the vibrating or resonating mass. Smaller resonating masses cause an increased admittance. Larger vibrating or resonating surfaces, on the other hand, increase the volume stroke or volume variation.

Figure 2:
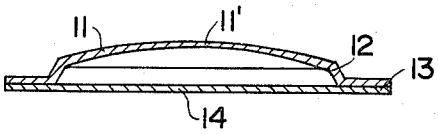
FIG. 2 illustrates a section through a resonator member wherein the center portion of a wall element is thinner than an outer region or ring zone.

FIG. 2 illustrates an embodiment wherein the resonating or vibrating mass is decreased by constructing the wall element 11 with a thickness which decreases radially inwardly toward the center region, where the greatest amplitude of oscillation occurs. The resonator of FIG. 2 has a base plate 14 and the curved wall element 11 having a center 11' of reduced wall thickness, is secured to the base plate 14 along the flanges 13. The wall element 11 also has a shoulder 12 as in FIG. 1.

Figure 3:
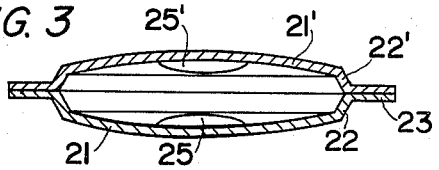
FIG. 3 is a section through a resonator member wherein the center portion of the wall element is reinforced or stiffened.

FIG. 3 shows a stiffening of the central region of both wall elements 21, 21' by means of struts 25, 25'. The struts 25, 25' are secured perpendicularly to the respective wall element inner surface and centrally thereof. The strut members 25 have a high areal moment of inertia whereby a piston like movement of the inner or central region of the wall members 21, 21' which movement results in an increased stroke of the interior volume which corresponds to a volume variation. The two wall elements 21, 21' are secured to each other along flanges 23, as in the other figures. This may be accomplished by any conventional means, e.g., an adhesive bond, screws, rivets, or the like. The shoulders 22, 22' are the same as in the other embodiments and may, for example, be made by deep drawing if the wall elements are of sheet metal.

Figure 4:
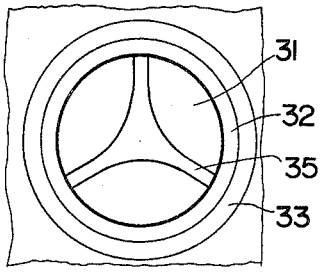
FIG. 4 shows a top plan view of a resonator member wherein the center portion of one or both wall elements is stiffened by means of spokes.

FIG. 4 illustrates a plan view of a wall member 31 with a shoulder region 32 and flange means 33. The central region of the wall member 31 is provided with spoke like support struts 35. The material of the wall member 31 between the spoke struts 35 has a reduced wall thickness for lessening the resonating mass.

Figure 5:
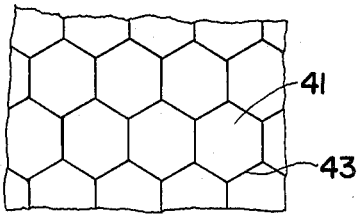
FIG. 5 shows schematically a top plan view of a plurality of resonator members each having a hexagonal outline.

FIG. 5 illustrates an embodiment of a resonator system wherein the base shape of the resonator members 41 is hexagonal. In this manner the seating surface 43 between adjacent resonator members is reduced, whereby the surface area of the resonating or vibrating surface is increased. The base shape of the wall members 41 need not be hexagonal as shown; rectangular, square, triangular, strip-like, or even asymmetrical base shapes are possible. However, shapes permitting an optimal surface area used when attaching the resonators, for example to a wall, are preferred.

FIGS. 6, 7, 8, and 9 illustrate embodiments for adjusting an inner damping in the present resonators whereby occurring noise may be absorbed by the resonator member or members. By matching the impedance of the resonator to the characteristic impedance of the surrounding medium makes it possible to realize substantially reflection-free walls.

Figure 6:
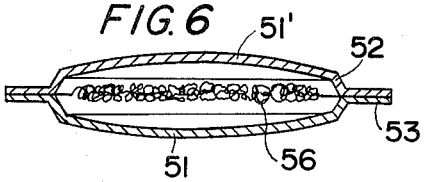
FIG. 6 illustrates a section through a resonator member with a residual damping gas in the partially evacuated volume and with flow impeding means located inside the resonator member.

FIG. 6 illustrates a resonator member formed by the wall elements 51, 51' and having shoulders 52 as well as flanges 53. The inner volume is not completely evacuated. Gas flow impeding means, such as a wire mesh 56, are arranged in the resonator volume. Since the middle portions of the wall elements 51, 51' have larger oscillation amplitudes than the edge regions, a transverse movement of the residual gas is caused in the interior volume. This movement is damped due to friction and is additionally damped by the flow impeding means or wire mesh 56. It is known that the viscosity of a gas is substantially independent of pressure. Thus, a sufficient damping is assured even at relatively low pressures inside the resonator volume. Residual gases having a small molecular diameter have a higher viscosity coefficient than gases with a large molecular diameter. The residual gas remaining inside the present resonators could be air or an inert gas.

Figure 7:
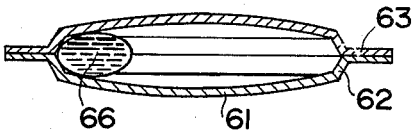
FIG. 7 shows a section through a resonator member with liquid drop means acting as damping means.

FIG. 7 illustrates a resonator with wall elements 61, shoulders 62 and flanges 63. Here the damping effect in the inner volume is caused by a drop of liquid 66 in the inner volume formed by the wall members 61. The liquid drop 66 is constantly deformed by the oscillatory motion whereby a damping effect is achieved.

Figure 8:
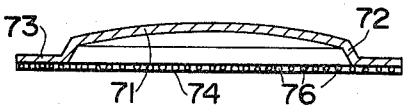
FIG. 8 illustrates a section through a resonator member wherein the damping is caused by eddy currents including magnets for generating such currents.

FIG. 8 shows a resonator member with a vaulted wall element 71 having a shoulder 72 and a flange 73 wherein the damping is caused by magnetic eddy currents. For this purpose, small magnets 76 are impressed into or embedded in a base plate 74. The wall element 71 is made of electrically conducting material, whereby a current is induced in the wall element 71 due to said relatively small magnets 76.

Figure 9:
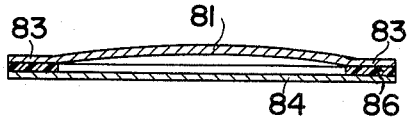
FIG. 9 illustrates a section through a resonator member with damping material inserted between the contact surfaces of the wall elements to provide a damping action when the wall elements are subjected to a clamping force.

FIG. 9 shows another example of producing a damping effect in the inner volume enclosed by a base plate 84 and a wall element 81, each with a respective flange or outer rim 83.

A damping material 86, for example adhesive materials, or synthetic materials are interposed between the flanges. Any relative movement between the wall element 81 and the base member 84 which is caused by an oscillatory motion of the wall element 81, is damped by the damping material 86.

Still another possibility of producing a damping effect is provided by the choice of material for the wall elements, for example, synthetic materials reinforced by glass fibers or by carbon fibers provide a higher material damping effect than metals.

FIGS. 10 and 11 illustrate construction features of resonator members for compensating pressure variations caused by barometric pressure changes or pressure changes due to relative elevation changes. A change in the external pressure also changes the working point of the oscillating resonator member. Due to the nonlinear spring characteristic of the resonator wall elements a different spring constant and hence a different resonating frequency results when external pressure changes occur. Generally, the effect of external pressure variations is insignificant on resonator systems having a wide noise-band range. Such resonator systems usually comprise several resonator members having graduated resonating frequencies each tuned to a different characteristic frequency. The effect of pressure variations in such systems is not significant because all of the resonating frequencies of the individual resonating members shift collectively, hence the wide-band effect is maintained. However, pressure variation compensations are recommended where the noise to be damped is within a narrow frequency range, where large pressure variations occur, and where resonator wall elements having a small weight per surface area.

The resonator of FIG. 10 is constructed with two wall elements 91 substantially as shown in FIG. 1. An intermediate spring member 97 is arranged between the flanges 93 of the wall elements 91. The intermediate spring member 97 is housed in a liquid-filled annular hose 98. The intermediate spring member 97 simultaneously divides the liquid content of the liquid filled hose 98 into two separated rings. Furthermore, the spring member 97 is provided with small passage bores 99 connecting the two otherwise separated liquid rings. The spring member 97 is compressed when the external pressure increases slowly whereby the ring hose 98 is compressed and spreads out radially due to flow through said bores 99 thereby decreasing the effective diameter of the wall elements 91. Consequently, the working point and the resonance frequency are maintained in the same position and at the same value. Rapid acoustical pressure variations, on the other hand, are unable to change the working point because of the small time constant of the fluid equilibrium flow through the bores 99. The hose 98 may be of rubber, for example. The liquid in the hose 98 may be an oil or glycerol.

FIG. 11 illustrates a further embodiment of a resonator with features for the compensation of pressure variations. In this embodiment, the wall element 101 is supported by a relatively strong or heavy annular spring member 107. The inner volume, formed by the wall element 101 and by the covering or base member 104 is not fully evacuated. The spring constant of the Belleville spring wall element 101 is set to a negative value in order to compensate for the spring action of the enclosed gas volume such as air or an inert gas. An increase in the external pressure causes a reduction of the inner volume due to the compression of a ring spring 108 in an annular hose 109 arranged between the flange 103 functioning similar to the intermediate spring 97 and ring hose 98 in FIG. 10. The reduction of the inner volume increases the spring constant of the enclosed residual gas in the inner volume of the resonator. Any further decrease in the negative spring action of the Belleville spring wall element 101 and the simultaneously increased spring action of the gas compensate each other whereby the resonance frequency remains constant. The same principle or effect may be obtained by utilizing solely the static resilence of the wall elements 101 without an additional ring spring 108.

FIG. 16 shows another possibility for compensating external pressure variations in a resonator arrangement comprising several square or rectangular resonator members 110 arranged, for example, in rows and columns. The inner volumes of the resonator members of a row are, for example, interconnected by means of gas passages 112. The passages 112 are in the walls 113 separating adjacent columns of resonator members 110 whereby the inner volumes of the resonator members forming a row are interconnected. Passages could also, or in the alternative, be provided in the walls separating adjacent rows of resonator members to interconnect the resonator members forming a column. The reduced pressure in the inner volumes is adjustable by means of these gas passages 112 in response to the change in external pressure. Accordingly, external pressure variations may be compensated for, for example, by means of a vapor-liquid system. If the temperature of the liquid is increased, then the vapor pressure rises thereby increasing the low pressure effective in the respective resonator member. An automatic compensation of pressure variations may be achieved by connecting a pressure chamber to the passage system. The pressure chamber of such an embodiment is constructed analogous to a Belleville spring member. A change in the external air pressure changes the inner volume, due to the static pressure movement, thus changing the internal pressure. The changed pressure is transmitted through the passages 112, whereby the resonator members are adjusted accordingly. It is advantageous to provide a separate pressure chamber for each of the closed partial regions of resonator members, thereby assuring that any damage caused by a leak is restricted to a respective partial region.

Another possibility for providing pressure compensation is seen in a resonator arrangement wherein the resonator members integrated to form strips or surface areas, are twisted, arched, or turned as a whole. This twisting, turning, or arching changes the characteristic frequency of the resonator members because of the initial stress or biasing caused thereby. The deforming of the resonator strips or surface areas may be accomplished automatically by the change in atmospheric pressure. The analogous principle may be applied to compensate for temperature related influences. For this purpose, a bimetallic element as an adjusting member is used in place of a barometric spring.

FIG. 17 shows an embodiment wherein the resonator member 150 comprises a barometer spring 151 and a corrugated cover member 152 secured to one surface of the barometer spring 151 to form a plurality of resonator volumes 153. The barometer spring 151 provides the desired compensation for external pressure variations by respectively bending or twisting its shape.

FIG. 18 shows an embodiment similar to that of FIG. 17, however, the barometer spring has been replaced by a temperature responsive bimetal strip 154 in FIG. 18, whereby the embodiment of FIG. 18 is capable of compensating for temperature changes.

FIGS. 12 to 15 show example embodiments of resonator members integrated into wall or similar surfaces. FIG. 12 shows a shutter type arrangement of a plurality of rows 111 of resonator elements for insulating against sound while maintaining free air passages as shown by the arrows in FIG. 12. These shutters may, for example, be used in windows, ventilating shafts, and intake and outlet openings. The shutters may be manufactured, for example, by stamping or pressing vaults or depressions into strips of sheet metal. Belleville spring members as described with reference to FIG. 1, are then formed by connecting two such strips to each other in a gas tight manner and under vacuum or partial vacuum. The surface of these strips is arranged in parallel to the direction of flow indicated by the arrows in FIG. 12. The rows 111 of resonator elements may be interconnected by wires or belts not shown.

FIGS. 13 to 15 illustrate example embodiments of sound absorbing walls, particularly walls with an additional increase in the wall surface area. In FIG. 13, the resonator members 121, constructed as described above, are applied to a profiled wall 123 having protrusions 123' for increasing the wall surface area to which the resonators may be secured, for example, by a conventional adhesive.

FIG. 14 shows a wall 130 covered by a combination of strip resonator systems 131 and 132. The resonator members 132 are secured directly to the wall 130. The resonator members 131 are spaced from the wall by spacers not shown. Air openings 139 are provided in the flanges of the resonators 131 so that even the rearwardly arranged Belleville spring resonator members 132 are loaded and hence become effective. The embodiment of FIG. 14 could be modified by placing the wall 130 between the two rows of resonator members 131, 132. In both instances the noise source would be located to the left of the wall shown in FIG. 14.

FIG. 15 shows an arrangement wherein the Belleville spring resonator members 141 are secured to the wall surface 140 in a fish scale fashion.

Although the invention has been described with reference to specific example embodiments, it is to be understood that it is intended to cover all modifications and equivalents within the scope of the appended claims.

What is claimed is:

1. A variable volume resonator for damping noise, comprising resonator wall means confining a volume which is at least partially evacuated; said wall means being constructed to form Belleville spring means, whereby said wall means have a small spring constant in response to reduced pressure loading relative to atmospheric pressure, said wall means comprising a central wall area, a peripheral wall area and shoulder means operatively located between the peripheral wall area and the central wall area of said wall means, said shoulder means connecting said central wall area to said peripheral wall area at least one of said wall means having a domed shape, said wall means having a given wall thickness "s", said domed shape having a height "h" within the range of about 0.5 to 5.0 times said given wall thickness "s", said wall means further having an effective diameter "d" within the range of about 30 to 300 times said given wall thickness "s".

2. The resonator of claim 1, wherein said shoulder means has the form of a truncated cone.

3. The resonator of claim 1, wherein said domed shape forms part of a sphere.

4. The resonator of claim 1, wherein the central wall area of said wall means is thinner than the peripheral wall area, whereby the resonating mass is decreased.

5. The resonator of claim 1, further comprising bending resistant strut means secured to said wall means for increasing the vibrating or oscillating surface area.

6. The resonator of claim 1, further comprising spoke shaped reinforcing means arranged on said wall means, whereby the vibrating or oscillating surface area is increased while the vibrating or oscillating mass is decreased.

7. The resonator of claim 1, comprising such a base shape that a plurality of such resonators may be combined to cover a surface with an optimal area utilization.

8. The resonator of claim 1, further comprising flow impeding means arranged in said wall confined volume for increasing the damping effect.

9. The resonator of claim 1, further comprising pressure compensating means for compensating changes in external atmospheric pressure.

10. The resonator of claim 9, wherein said pressure compensating means comprise annular spring means; liquid filled hose means located between adjacent wall means, said annular spring means being arranged in said liquid filled hose means to form two separate regions in said hose means and passages in said annular spring means for connecting said two separate regions, whereby a compression of said annular spring means deforms said hose means to reduce said inner volume.

11. The resonator of claim 1, wherein said domed shape is defined by an nth power mathematical function.

* * * * *